US010164335B2

(12) United States Patent
West et al.

(10) Patent No.: US 10,164,335 B2
(45) Date of Patent: Dec. 25, 2018

(54) UNIT CELL FILTERING AND DIPLEXING FOR ELECTRONICALLY SCANNED ARRAYS

(71) Applicant: Rockwell Collins, Inc., Cedar Rapids, IA (US)

(72) Inventors: James B. West, Cedar Rapids, IA (US); Anders P. Walker, Marion, IA (US); Nathan P. Lower, North Liberty, IA (US); Joseph M. Bohl, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 342 days.

(21) Appl. No.: 14/865,626

(22) Filed: Sep. 25, 2015

(65) Prior Publication Data

US 2017/0093037 A1 Mar. 30, 2017

(51) Int. Cl.

| | |
|---|---|
| ***H01Q 3/00*** | (2006.01) |
| ***H01Q 3/34*** | (2006.01) |
| ***H01Q 21/00*** | (2006.01) |
| ***H01Q 3/24*** | (2006.01) |
| ***H01Q 21/06*** | (2006.01) |
| *H01Q 3/26* | (2006.01) |
| *H01Q 3/22* | (2006.01) |
| *H01Q 1/40* | (2006.01) |

(52) U.S. Cl.

CPC ..... *H01Q 3/34* (2013.01); *H01Q 3/24* (2013.01); *H01Q 21/0006* (2013.01); *H01Q 21/061* (2013.01); *H01Q 1/405* (2013.01); *H01Q 3/22* (2013.01); *H01Q 3/26* (2013.01); *H01Q 21/0093* (2013.01); *H01Q 21/065* (2013.01)

(58) Field of Classification Search

CPC .. H01Q 3/34; H01Q 3/24; H01Q 3/22; H01Q 3/26; H01Q 21/0006; H01Q 21/065

USPC ..... 342/371, 372

See application file for complete search history.

(56) References Cited

U.S. PATENT DOCUMENTS 6,266,015 B1 * 7/2001 Heckaman ..... H01Q 1/38 343/700 MS
6,388,631 B1 * 5/2002 Livingston ..... H01Q 3/24 342/374
6,693,590 B1 * 2/2004 Toplicar ..... H01Q 3/26 342/372
6,965,349 B2 * 11/2005 Livingston ..... H01Q 1/422 342/374

(Continued)

FOREIGN PATENT DOCUMENTS

WO WO-2015/128005 A1 * 9/2015 ..... H03H 7/46

*Primary Examiner* — Chuong P Nguyen
(74) *Attorney, Agent, or Firm* — Angel N. Gerdzhikov; Donna P. Suchy; Daniel M. Barbieri

(57) ABSTRACT

Electronically scanned array (ESA) antennas are disclosed. An antenna may include an electronically scanned array (ESA) panel. The ESA panel may include a plurality of transmit/receive (T/R) modules, and each T/R module of the plurality of T/R modules may be contained within a unit cell of the ESA panel, where the unit cell has a surface area constrained by a maximum operating frequency of the ESA panel. The antenna may also include at least one radio frequency (RF) filter positioned within each particular unit cell of the ESA panel. The at least one RF filter may be configured to provide RF filtering specifically for the T/R module co-located within that particular unit cell of the ESA panel.

15 Claims, 3 Drawing Sheets

(56) References Cited

U.S. PATENT DOCUMENTS

| | | | | |
|---|---|---|---|---|
| 7,079,588 | B1 * | 7/2006 | Doucette | H01Q 3/26 375/295 |
| 7,636,554 | B2 * | 12/2009 | Sugar | H04B 1/005 455/272 |
| 7,733,265 | B2 * | 6/2010 | Margomenos | G01S 7/032 342/175 |
| 8,604,982 | B2 * | 12/2013 | Achour | H01Q 1/38 343/700 MS |
| 8,644,197 | B2 * | 2/2014 | Lee | H01Q 9/40 340/572.7 |
| 8,810,455 | B2 * | 8/2014 | Achour | H01Q 21/065 343/700 MS |
| 9,128,189 | B1 * | 9/2015 | West | G01S 7/03 |
| 9,543,661 | B2 * | 1/2017 | Lee | H01Q 1/243 |
| 9,647,345 | B2 * | 5/2017 | Hyde | H01Q 15/0053 |
| 2009/0219213 | A1 * | 9/2009 | Lee | H01P 3/00 343/700 MS |
| 2009/0251356 | A1 * | 10/2009 | Margomenos | G01S 7/03 342/70 |
| 2009/0251362 | A1 * | 10/2009 | Margomenos | G01S 7/032 342/175 |
| 2010/0283692 | A1 * | 11/2010 | Achour | H01Q 21/065 343/702 |
| 2012/0026043 | A1 * | 2/2012 | Rida | H01Q 1/3233 343/700 MS |
| 2017/0012651 | A1 * | 1/2017 | Ella | H03H 7/465 |

* cited by examiner

UNIT CELL FILTERING AND DIPLEXING FOR ELECTRONICALLY SCANNED ARRAYS

BACKGROUND

An electronically scanned array, or ESA, is a type of phased array whose transmitter and receiver functions are composed of numerous small transmit/receive (T/R) modules. An ESA is able to aim its beam by emitting separate radio waves from each module that interfere constructively at certain angles, allowing the ESA to be steered electronically. An ESA may therefore also be referred to as an electronically steerable antenna.

SUMMARY

In one aspect, embodiments of the inventive concepts disclosed herein are directed to an antenna. The antenna may include an electronically scanned array (ESA) panel. The ESA panel may include a plurality of transmit/receive (T/R) modules, and each T/R module of the plurality of T/R modules may be contained within a unit cell of the ESA panel, where the unit cell has a surface area constrained by a maximum operating frequency of the ESA panel. The antenna may also include at least one radio frequency (RF) filter positioned within each particular unit cell of the ESA panel. The at least one RF filter may be configured to provide RF filtering specifically for the T/R module co-located within that particular unit cell of the ESA panel.

In a further aspect, embodiments of the inventive concepts disclosed herein are directed to an antenna. The antenna may include an electronically scanned array (ESA) panel. The ESA panel may include a plurality of transmit/receive (T/R) modules, and each T/R module of the plurality of T/R modules may be contained within a unit cell of the ESA panel, where the unit cell has a surface area constrained by a maximum operating frequency of the ESA panel. The antenna may also include a plurality of radio frequency (RF) filters positioned within each particular unit cell of the ESA panel. The plurality of RF filters may be configured to provide RF filtering specifically for each of a plurality of radiating elements of the T/R module co-located within that particular unit cell of the ESA panel.

In another aspect, embodiments of the inventive concepts disclosed herein are directed to an antenna. The antenna may include an electronically scanned array (ESA) panel. The ESA panel may include a plurality of transmit/receive (T/R) modules, and each T/R module of the plurality of T/R modules may be contained within a unit cell of the ESA panel, where the unit cell has a surface area constrained by a maximum operating frequency of the ESA panel. The antenna may also include a plurality of diplexers positioned within each particular unit cell of the ESA panel. Each diplexer of the plurality of diplexers may be associated with one of a plurality of radiating elements of the T/R module co-located within that particular unit cell of the ESA panel, and the plurality of diplexers may be configured to support full duplex operations of the ESA panel.

It is to be understood that both the foregoing general description and the following detailed description are exemplary and explanatory only and are not restrictive of the inventive concepts disclosed and claimed herein. The accompanying drawings, which are incorporated in and constitute a part of the specification, illustrate embodiments of the inventive concepts and together with the general description, serve to explain the principles and features of the inventive concepts disclosed herein.

BRIEF DESCRIPTION OF THE DRAWINGS

The numerous objects and advantages of the inventive concepts disclosed herein may be better understood by those skilled in the art by reference to the accompanying figures in which.

DETAILED DESCRIPTION

Reference will now be made in detail to exemplary embodiments of the inventive concepts disclosed herein, examples of which are illustrated in the accompanying drawings.

Embodiments in accordance with the inventive concepts disclosed herein are directed to systems and techniques for providing radio frequency (RF) transmitter and receiver filtering to electronically scanned arrays (ESAs).

Figure 1:
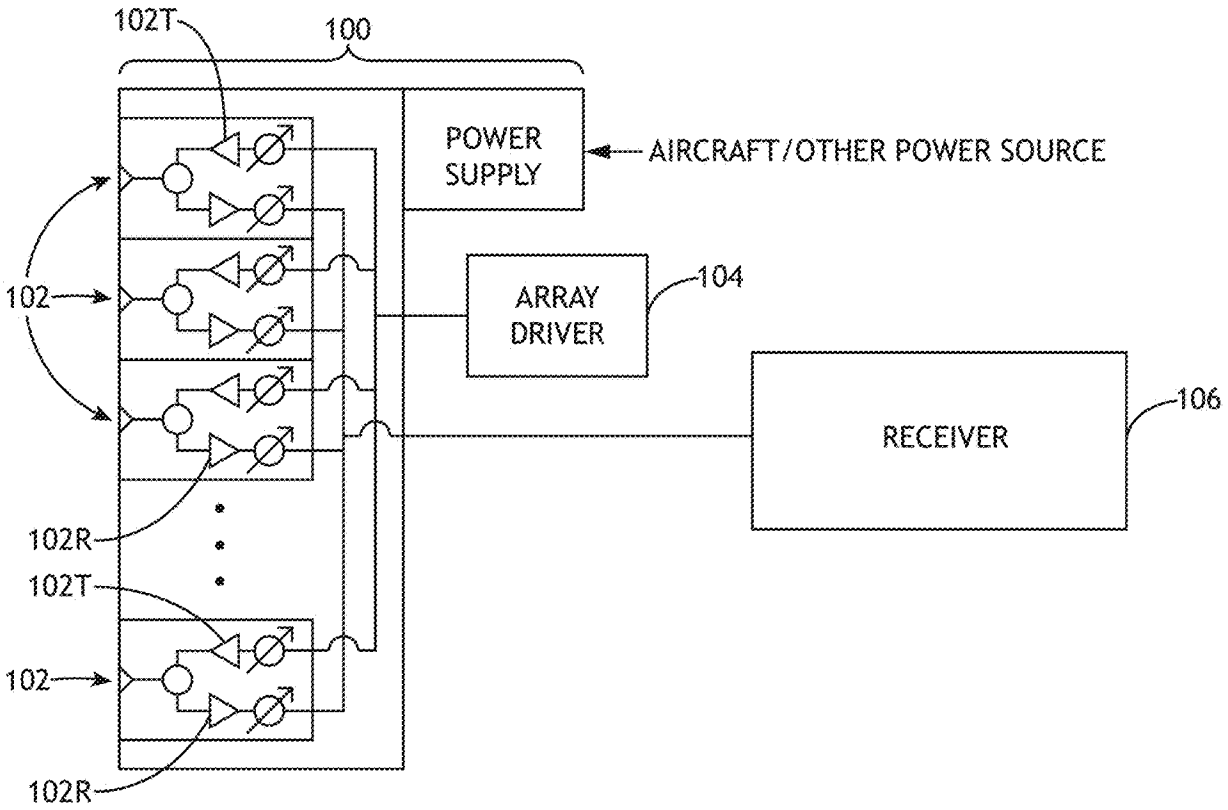
FIG. 1 is a simplified block diagram depicting an exemplary electronically scanned array (ESA)

It is noted that providing RF filtering to ESAs is difficult partly due to the distributed nature of the radiating elements contained within the ESAs. Referring to FIG. 1, for example, a simplified block diagram depicting an exemplary ESA 100 is shown. More specifically, the ESA 100 may include a plurality of transmit/receive (T/R) modules 102, each of which may include a transmitter 102T and a receiver 102R. The operations of the transmitters 102T may be controlled by an array driver 104, which may drive the transmitters 102T to facilitate RF transmissions of the ESA 100. Signals received at the receivers 102R may be provided to a receiver unit 106, which may include processing units such as analog-to-digital converters and the like that are configured to process the RF signals received by the ESA 100.

It is noted that while the T/R modules 102 configured in this manner may be used to jointly function as an electronically steerable antenna, they also forces the transmitters 102T and the receivers 102R to be distributed across the antenna aperture, making conventional single-point RF filters inoperable in ESA applications.

Figure 2:
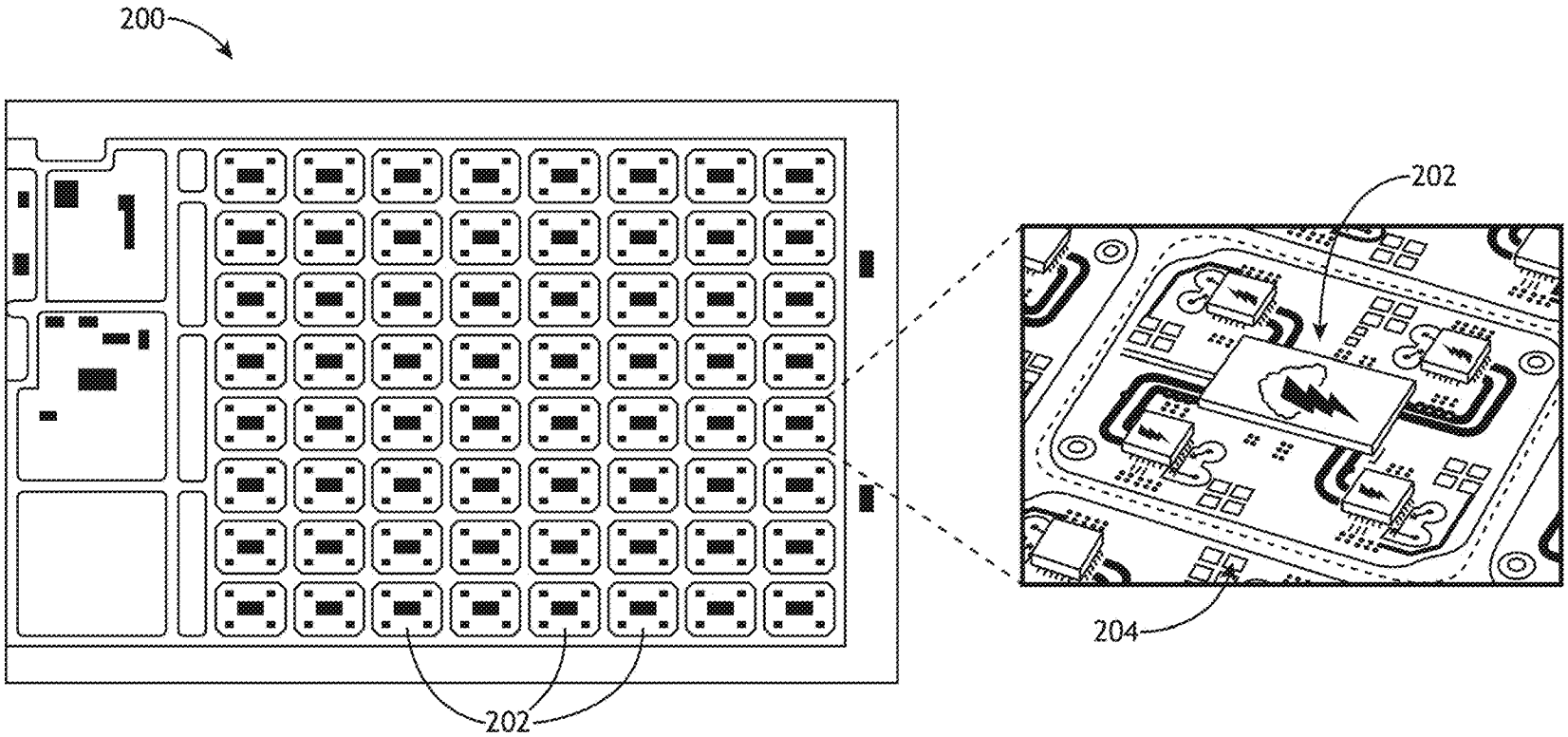
FIG. 2 is a top view of a plurality of unit cells forming an exemplary ESA panel.

Embodiments in accordance with the inventive concepts disclosed herein utilize a technique referred to as unit cell filtering to provide RF filtering to ESAs. Unit cell filtering means that all filtering required for a given radiating element is contained within a unit cell in which the given radiating element is co-located. FIG. 2 is a top view of an exemplary ESA panel 200 that may help illustrate the unit cell filtering technique. It is to be understood that while the exemplary ESA panel 200 as shown has a rectangular array lattice, such a configuration is merely exemplary and is not meant to be limiting. It is contemplated that the unit cell filtering technique disclosed herein is applicable to ESA panels having other types of lattices (e.g., triangular or the like) without departing from the broad scope of the inventive concepts disclosed herein.

As shown in FIG. 2, a T/R module 202, including all of its radiating elements and circuitry, is contained within a unit cell 204. The surface area of the unit cell 204 is typically limited to no more than $(\lambda/2)\times(\lambda/2)=\lambda^2/4$, where $\lambda$ is the wavelength of the RF wave determined based on the maximum operating frequency of the ESA panel 200. Unit cells 204 are defined in this manner to help prevent grating lobes from occurring over the scan volume of the ESA panel 200. The unit cell filtering technique, therefore, needs to be configured accordingly to conform to the dimensional constraints associated with the unit cells 202.

Figure 3:
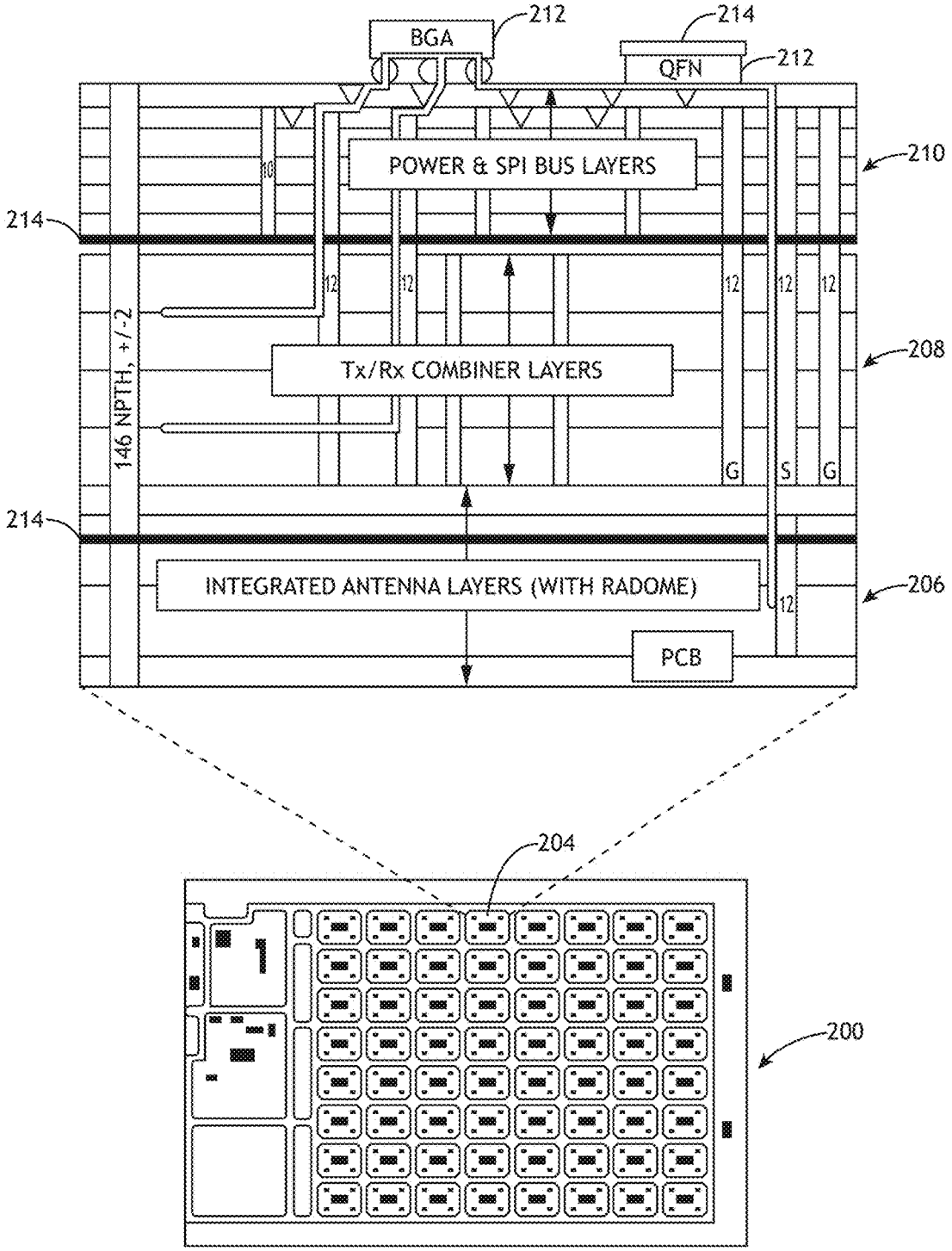
FIG. 3 is a cross-sectional depiction of a unit cell according to an exemplary embodiment of the inventive concepts disclosed herein.

In some embodiments, unit cell filtering may be accomplished by surface mounting and/or embedding filters to the radiating elements contained within a unit cell 204. For illustrative purposes, a cross-sectional view of an exemplary unit cell 204 is shown in FIG. 3. The unit cell 204 may include one or more integrated antenna/radome layers 206, one or more transmitter/receiver feed manifold layers 208, one or more power and serial peripheral interconnect layers 210, and one or more interposers 212. It is contemplated that the various layers 206-210 and the interposers 212 may be laminated, soldered, or otherwise secured/connected together.

Also shown in FIG. 3 are the various exemplary locations where filters 214 may be positioned within the unit cell 204. For instance, one or more filters 214 may be surface mounted or integrated into one or more interposers 212. Alternatively (or additionally), one or more filters 214 may be embedded into electrical interconnects between an interposer 208 and the interconnect layers 210. Similarly, one or more filters 214 may be embedded (e.g., laminated) within one of the layers 206-210 in the printed circuit board stack up.

It is contemplated that the filters 214 may be positioned at various other locations as well. For instance, the filters 214 may be structured within a multi-layered interposer 212, installed as surface mount lumped elements on the interposer 212 and/or the printed transmission lines of the printed circuit board stack up or the like. It is contemplated that other locations may also be suitable for filter placement without departing from the broad scope of the inventive concepts disclosed herein, as long as the filters 214 used are compatible with the dimensional constraints imposed on the unit cell 204.

It is also contemplated that the number of filters 214 needed and the specific RF range(s) that needed to be filtered may vary and may depend on system requirements of the antenna. The filters 214 may all reside in a dedicated filter area provided within the unit cell 204, or distributed throughout the various layers as previously described. It is to be understood that the cross-sectional depictions of the unit cell 204 shown in FIG. 3 is merely exemplary and is not meant to be limiting. It is contemplated that while the structures of the unit cells may vary, the unit cell filtering technique configured in accordance with the inventive concepts disclosed herein may still be applicable without departing from the broad scope of the inventive concepts disclosed herein.

It is further contemplated that the filters 214 utilized in accordance with the inventive concepts disclosed herein may be constructed via a fabrication process that allows the filters 214 to be miniaturized to have very small dimensions relative to the radiating elements contained within the ESA panel 200. In certain embodiments, a miniaturized filter occupying an area of approximately 2.25×2.25 $mm^2$ may be utilized. It is noted that utilizing such miniaturized filters may be advantageous especially for antennas that may operate in high frequency ranges. For instance, an antenna capable of operating in the Q band (e.g., 45 GHz) may require its unit cells 204 to be contained within an area of approximately 3.33×3.33 $mm^2$, and miniaturized filters 214 that are approximately 2.25×2.25 $mm^2$ in size are designed to be compatible with the dimensional constraints imposed on such unit cells 204.

It is to be understood that the specific dimensional constraints mentioned above are not meant to be limiting. The specific dimensions are presented merely to help illustrate one of the advantages provided by the unit cell filtering technique configured in accordance with the inventive concepts disclosed herein. It is noted that the unit cell filtering technique may also provide other advantages as well.

For instance, an ESA panel 200 implementing unit cell filtering may utilize RF filtering capabilities provided by the filters to remove periodic (deterministic) and random amplitude as well as delay errors from the phase shifters of the T/R modules 202. Removal/reduction of such errors may help reduce peak side lobe levels that may occur due to periodic errors on the aperture. The overall average side lobe level noises may also be reduced with the removal/reduction of random errors, resulting in a tighter amplitude and phase match that can provide higher quality radiation patterns and better out of band rejections.

Furthermore, it is contemplated that the unit cell filtering technique disclosed herein may be extended to support diplexing. More specifically, one or more miniature filters may be utilized to form a part of a diplexer, which may in turn be utilized to enable bi-directional (duplex) communication for a particular radiating element contained within the ESA panel 200. By providing a diplexer constructed in this manner to every radiating element contained within every unit cell 204 of the ESA panel 200, bi-directional, full duplex communication may be supported. It is contemplated that these diplexers may be positioned within the unit cells 204 in a similar manner as the filters 216 previously described. That is, they may be implemented as lumped elements or as distributed transmission line elements throughout the various layers without departing from the broad scope of the inventive concepts disclosed herein.

It is to be understood that the unit cell filtering technique disclosed herein may be applicable to both active and passive ESAs. It is to be understood that the specific order or hierarchy of steps in the processes disclosed is an example of exemplary approaches. It is to be understood that the specific order or hierarchy of steps in the processes may be rearranged while remaining within the broad scope of the inventive concepts disclosed herein.

It is believed that the inventive concepts disclosed herein and many of their attendant advantages will be understood by the foregoing description, and it will be apparent that various changes may be made in the form, construction, and arrangement of the components thereof without departing from the broad scope of the inventive concepts or without sacrificing all of their material advantages. The form herein before described being merely an explanatory embodiment thereof, it is the intention of the following claims to encompass and include such changes.

What is claimed is:

1. An antenna, comprising:

an electronically scanned array (ESA) panel, the ESA panel being an active electronically scanned array, the ESA panel including a plurality of unit cells, each unit cell of the plurality of unit cells including:

a transmit/receive (T/R) module; and at least one radio frequency (RF) filter, the at least one RF filter configured to provide RF filtering specifically for the T/R module co-located within that particular unit cell of the ESA panel, wherein each transmit/receive module for each unit cell is configured to be directed at a desired angle, the at least one RF filter positioned within each particular unit cell of the ESA panel includes a plurality of RF filters, the plurality of RF filters is configured to provide RF filtering specifically for each of a plurality of radiating elements of the T/R module co-located within that particular unit cell of the ESA panel, wherein each unit cell includes the at least one RF filter of the plurality of RF filters being a part of a diplexer associated with each of the plurality of radiating elements of the T/R module co-located within that particular unit cell of the ESA panel, wherein the ESA panel is an active electronically scanned array.

2. The antenna of claim 1, wherein the at least one RF filter is surface mounted to at least one interposer of the T/R module.

3. The antenna of claim 1, wherein the at least one RF filter is integrated into at least one interposer of the T/R module.

4. The antenna of claim 1, wherein the at least one RF filter is embedded into at least one electrical interconnect between at least one interposer of the T/R module and at least one printed circuit board layer of the T/R module.

5. The antenna of claim 1, wherein the at least one RF filter is embedded into a printed circuit board stack up of the T/R module.

6. The antenna of claim 1, wherein the at least one RF filter is embedded into at least one printed transmission line of a printed circuit board stack up of the T/R module.

7. The antenna of claim 1, wherein the at least one RF filter is positioned within a dedicated filter area defined within the unit cell, and wherein the at least one RF filter functions as a lumped element configured to provide RF filtering.

8. An antenna, comprising:

an electronically scanned array (ESA) panel, the ESA panel being an active electronically scanned array, the ESA panel including a plurality of transmit/receive (T/R) modules, each T/R module of the plurality of T/R modules being contained within a unit cell of the ESA panel; and a plurality of radio frequency (RF) filters positioned within each particular unit cell of the ESA panel, the plurality of RF filters configured to provide RF filtering specifically for each of a plurality of radiating elements of the T/R module co-located within that particular unit cell of the ESA panel, wherein each transmit/receive module for each unit cell is configured to be directed at a desired angle, each unit cell includes RF filters of the plurality of RF filters being a part of a diplexer associated with each of the plurality of radiating elements of the T/R module co-located within that particular unit cell of the ESA panel.

9. The antenna of claim 8, wherein at least one RF filter of the plurality of RF filters is surface mounted to at least one interposer of the T/R module.

10. The antenna of claim 8, wherein at least one RF filter of the plurality of RF filters is integrated into at least one interposer of the T/R module.

11. The antenna of claim 8, wherein at least one RF filter of the plurality of RF filters is embedded into at least one electrical interconnect between at least one interposer of the T/R module and at least one printed circuit board layer of the T/R module.

12. The antenna of claim 8, wherein at least one RF filter of the plurality of RF filters is embedded into a printed circuit board stack up of the T/R module.

13. The antenna of claim 8, wherein at least one RF filter of the plurality of RF filters is embedded into at least one printed transmission line of a printed circuit board stack up of the T/R module.

14. The antenna of claim 8, wherein the plurality of RF filters is positioned within a dedicated filter area defined within the unit cell, and wherein the plurality of RF filters functions as a lumped element configured to provide RF filtering.

15. An antenna, comprising:

an electronically scanned array (ESA) panel, the ESA panel being an active electronically scanned array, the ESA panel including a plurality of unit cells, each unit cell of the plurality of unit cells including:

a transmit/receive (T/R) module; and a plurality of diplexers, the plurality of diplexers formed from a plurality of radio frequency (RF) filters positioned within each particular unit cell of the ESA panel, each diplexer of the plurality of diplexers being associated with one of a plurality of radiating elements of the T/R module co-located within that particular unit cell of the ESA panel, the plurality of RF filters configured to provide RF filtering specifically for each of a plurality of radiating elements of the T/R module co-located within that particular unit cell of the ESA panel, the plurality of diplexers being configured to support full duplex operations of the ESA panel, wherein each transmit/receive module for each unit cell is configured to be directed at a desired angle.

* * * * *